US007219471B2

(12) United States Patent
Cittadini et al.

(10) Patent No.: US 7,219,471 B2
(45) Date of Patent: May 22, 2007

(54) REFRIGERATOR CABINET SEALING ASSEMBLY HAVING A BELLOWS-SEAL GASKET

(75) Inventors: Paolo Cittadini, Luvinate-Varese (IT); Adriano Merla, Angera-Varese (IT)

(73) Assignee: Industrie Ilpea S.p.A., Malgesso-Varese (IT)

( * ) Notice: Subject to any disclaimer, the term of this patent is extended or adjusted under 35 U.S.C. 154(b) by 0 days.

(21) Appl. No.: 10/467,746

(22) PCT Filed: Jul. 6, 2001

(86) PCT No.: PCT/EP01/07834

§ 371 (c)(1),
(2), (4) Date: Aug. 12, 2003

(87) PCT Pub. No.: WO02/070971

PCT Pub. Date: Sep. 12, 2002

(65) Prior Publication Data

US 2004/0051427 A1 Mar. 18, 2004

(30) Foreign Application Priority Data

Mar. 7, 2001 (IT) ..... MI2001A0472

(51) Int. Cl.
*F25D 23/08* (2006.01)

(52) U.S. Cl. ..... 49/478.1; 49/489.1

(58) Field of Classification Search ..... 49/478.1, 49/489.1, 490.1, 492.1, 498.1
See application file for complete search history.

(56) References Cited

U.S. PATENT DOCUMENTS

| | | | | | |
|---|---|---|---|---|---|
| 4,119,325 | A | * | 10/1978 | Oakley et al. | 277/642 |
| 4,617,759 | A | * | 10/1986 | Pasqualini et al. | 49/478.1 |
| 4,800,681 | A | | 1/1989 | Skillen et al. | |
| 5,072,546 | A | * | 12/1991 | Ogawa | 49/490.1 |
| 5,194,312 | A | | 3/1993 | Verig | |
| 5,916,076 | A | | 6/1999 | Cittadini et al. | |
| 6,023,888 | A | * | 2/2000 | Dover | 49/441 |
| 6,058,657 | A | * | 5/2000 | Merla | 49/478.1 |
| 6,227,634 | B1 | * | 5/2001 | Cittadini et al. | 312/296 |
| 6,247,271 | B1 | * | 6/2001 | Fioritto et al. | 49/490.1 |

FOREIGN PATENT DOCUMENTS

| | | | |
|---|---|---|---|
| DE | 37 42 978 | | 6/1989 |
| EP | 0 319 087 | * | 6/1989 |

* cited by examiner

*Primary Examiner*—Gregory J. Strimbu
(74) *Attorney, Agent, or Firm*—Hedman & Costigan P.C.; James V. Costigan

(57) ABSTRACT

A sealing assembly for a refrigerator which comprises a bellows-seal gasket and a profile as a single piece or as multiple pieces where the profile has a base having at opposite ends, sealing strips and has a groove for replacement of the bellows-seal gasket. The profile is provided with a side branch that terminates in a grooved seat having a C-shaped cross-section for receiving an edge of an inner door panel and having a sealing strip that is provided at the end of the grooved seat. The inner door panel is bent to ensure optimal contact with the sealing strip of the side branch.

9 Claims, 6 Drawing Sheets

REFRIGERATOR CABINET SEALING ASSEMBLY HAVING A BELLOWS-SEAL GASKET

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION (1) Field of the Invention

The present invention relates to an improved sealing assembly for refrigerator cabinets and the like with a profile made of plastic material.

(2) Description of Related Art

It is known from the Italian Patent No. 1281660 held by the present applicant, a profile made of plastic material for refrigerator cabinets and the like, where the said refrigerator cabinets are equipped with a door and an inner door panel constrained to the structure, said profile having a bellows-type gasket portion which provides a sealed closing between the door and the cabinet. In this embodiment, the profile and the gasket portion are coupled together or form a single integrated piece produced by co-extrusion of two materials having different degrees of rigidity so as to enable, if necessary, convenient detachment of the gasket portion from the profile along the area of their connection. In addition, the profile has at least one elastically compliant side branch which acts as a spring to connect together by snap action the profile and the inner door panel. In the aforesaid profile, a groove is present which is identified by a pair of walls that extend vertically or obliquely from a base which, in the operative position of coupling, overlaps the door and the inner door panel along their line of coupling.

For its installation, the profile, which carries the co-extruded gasket, is conveniently arranged in the form of a frame and is supplied to the manufacturer of the refrigerator cabinet in this form. As further references to the prior art, the following European patents held by the present applicant may be cited: EP 0 146 994 and EP 0 319 087.

The frame made of the profile is caused to descend, for example by means of an appropriate mechanical arm, towards the inner door panel, which is, for instance, suitably positioned on a support that blocks it in place. As soon as the arm of the side branch comes into contact with the edge of the inner door panel, under the thrust of the said edge it yields and starts to bend elastically inwards like a spring about its own flexible fulcrum. Once the compliant side branch has completed its travel along the edge of the inner door panel and when the said edge has reached the height of the above-mentioned groove, the branch, as a result of its own elastic return, snaps into position engaging the edge of the inner door panel, so blocking the said edge. Insertion of the frame welded on the inner door panel may be achieved with great ease even manually, provided that care is taken to engage first the corners, two at a time, and then complete the insertion in the points of the perimeter where the edge of the inner door panel has not yet completely entered the groove of the side branch.

The profile and the inner door panel thus assembled are then rested on the door (for example, by means of a robotized system), and the entire assembly is blocked by means of foam-injection into the gap between the door and the inner door panel, with functions of thermal insulation.

In the profile in question, the base extends on a single plane or on planes that are slightly staggered with respect to one another. The base terminates laterally with a pair of sealing strips made of a soft material co-extruded together with the rigid material of the profile. The said strips constitute the gaskets containing the foam. In particular, the sealing strip provided to ensure operative sealing on the inner door panel is made in such a way as to compensate for the distance between the base of the profile and the inner door panel itself, between which there remains identified a gap for the elastic return of the engaging tooth of the side branch, and in such a way as to facilitate the movement of engagement of the said branch on the inner door panel. The said sealing strip consequently also has the function of facilitating said movement of the side branch because it maintains the distance between the base of the profile and the inner door panel, leaving free play for said engagement tooth in the useful gap referred to above.

It should in any case be emphasized that leakage of foam along the perimeter of the door is very rare, whereas it is precisely the area of the corners where welding is carried out that proves particularly critical.

It has in fact been noted that in the welded corner, the side branch, which terminates with a grooved seat, must remain elastically mobile in order to guarantee functionality of the profile, and consequently must not be welded. To avoid welding, the side branch must be cut 2–3 mm more than the cutting plane of the entire section of the profile. Albeit preventing the branch from being welded, this solution, in the step of welding of the four sides of the frame, leads to the presence of a 2–3 mm slit along the entire length of the side branch.

If the dimensional tolerances of assembly of the three components making up the door—namely, inner door panel, frame, and steel-metal shell—are not optimal, this slit leads to leakage of foam. In an attempt to prevent such leakage, the slit is closed with adhesive tape by means of an operation that requires time and involves loss of productivity.

The purpose of the present invention is to further improve tightness of the seal to prevent any foam from leaking during the step of foam-injection in a profile of the type referred to.

The above requirement derives from the fact that the parts to be assembled, and in the first place the profile and inner door panel, are manufactured with dimensional tolerances that preferably tend to be increasingly wide.

It should therefore once again be emphasized that the sealing strip that extends from the base of the profile towards the inner door panel, as described in the Italian Patent No. 1281660 referred to previously, proves in practice frequently insufficient to contain the foam when the dimensional tolerances between the door and the inner door panel exceed a certain limit. This is especially true when the foam is injected in the liquid phase according to the system known as "foam chamber" system, the said chamber being closed and inclined on its longer side or on its shorter side. In this case, the liquid pours, in fact, immediately onto the side opposite to the one into which the foam is injected, and the seal between the elastic side branch of the profile and the inner door panel may prove insufficient.

The fact that the foam comes out during the stage of foam injection between the door and the inner door panel may mean damage of an aesthetic nature (the foam that comes out is visible), but, above all, serious functional damage (the foam that leaks through the passages on account of insufficient sealing solidifies and causes serious imbalance in the set of the assembled door-inner door panel system).

BRIEF SUMMARY OF THE INVENTION

The solution to the technical problem summarized above is afforded by the present invention by means of an improved sealing assembly for refrigerator cabinets and the like with a profile made of plastic material.

BRIEF DESCRIPTION OF THE SEVERAL VIEWS OF THE DRAWINGS

The characteristics and advantages of an improved assembly for refrigerator cabinets and the like with a profile made of plastic material according to the present invention will emerge more clearly evident from the ensuing description, which is provided by way of non-limiting example illustrating embodiments and practical implementation, with reference to the attached figures, in which.

DETAILED DESCRIPTION OF THE INVENTION

Figure 1:
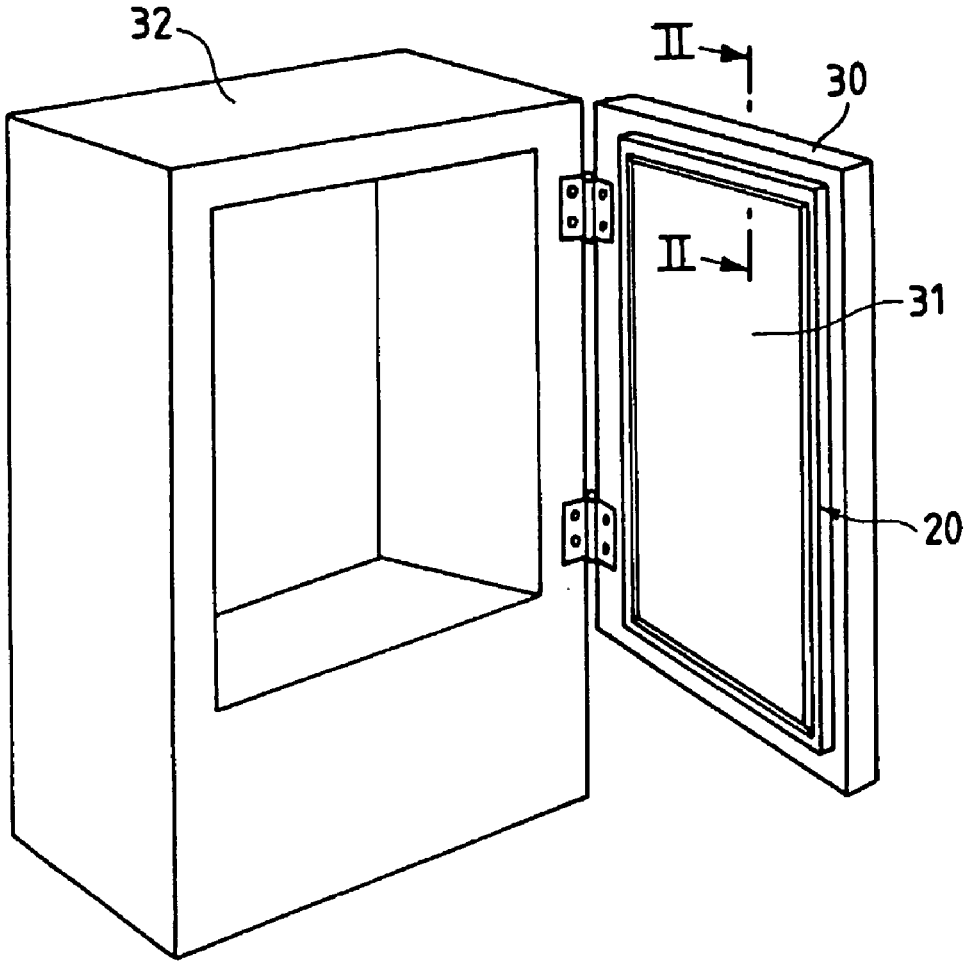
FIG. 1 is a schematic perspective view of a refrigerator cabinet with a door and inner door panel to which a profile is applied to make up a sealing assembly according to the invention.

With reference to FIG. 1, an improved sealing assembly for refrigerator cabinets and the like with a profile made of plastic material according to invention is shown. In this assembly, a profile is provided, designated as a whole by 1. The profile 1 is operatively mounted between a door 30 and an inner door panel 31, and has a complex section which presents, on the side facing, in the operative position (FIG. 2), a cabinet 32 of a refrigerator, a base 3 which is substantially plane and extends on planes that are slightly staggered with respect to one another. The base 3 terminates, on a side part, with a sealing strip 15 and, on the opposite part, with a sealing strip 4, both of the said sealing strips being made of soft material co-extruded with the rigid material of the profile 1. In an intermediate position, the section of the profile 1 assumes an irregular T shape as a result of a central rib 18 which extends vertically in the direction opposite to the direction facing the cabinet 32, assuming a slightly angled conformation inwards. From the end of the aforesaid rib 18 there extends a side branch 7, which is elastically compliant like a spring about a fulcrum 8 consisting of an insert made of soft material co-extruded with the rigid material of the profile 1.

The side branch 7 terminates with a grooved seat 19 having a substantially C-shaped cross-section which includes a tooth 41 designed for hooking onto the inner door panel 31.

In the opposite part of the profile 1, namely the one facing the cabinet in the operative position, there extend, from the base 3 in a substantially vertical direction, a pair of walls 5 terminating with a flanged edge 5', within which there thus remains identified a groove 23 designed to receive a replacement gasket.

Figure 2:
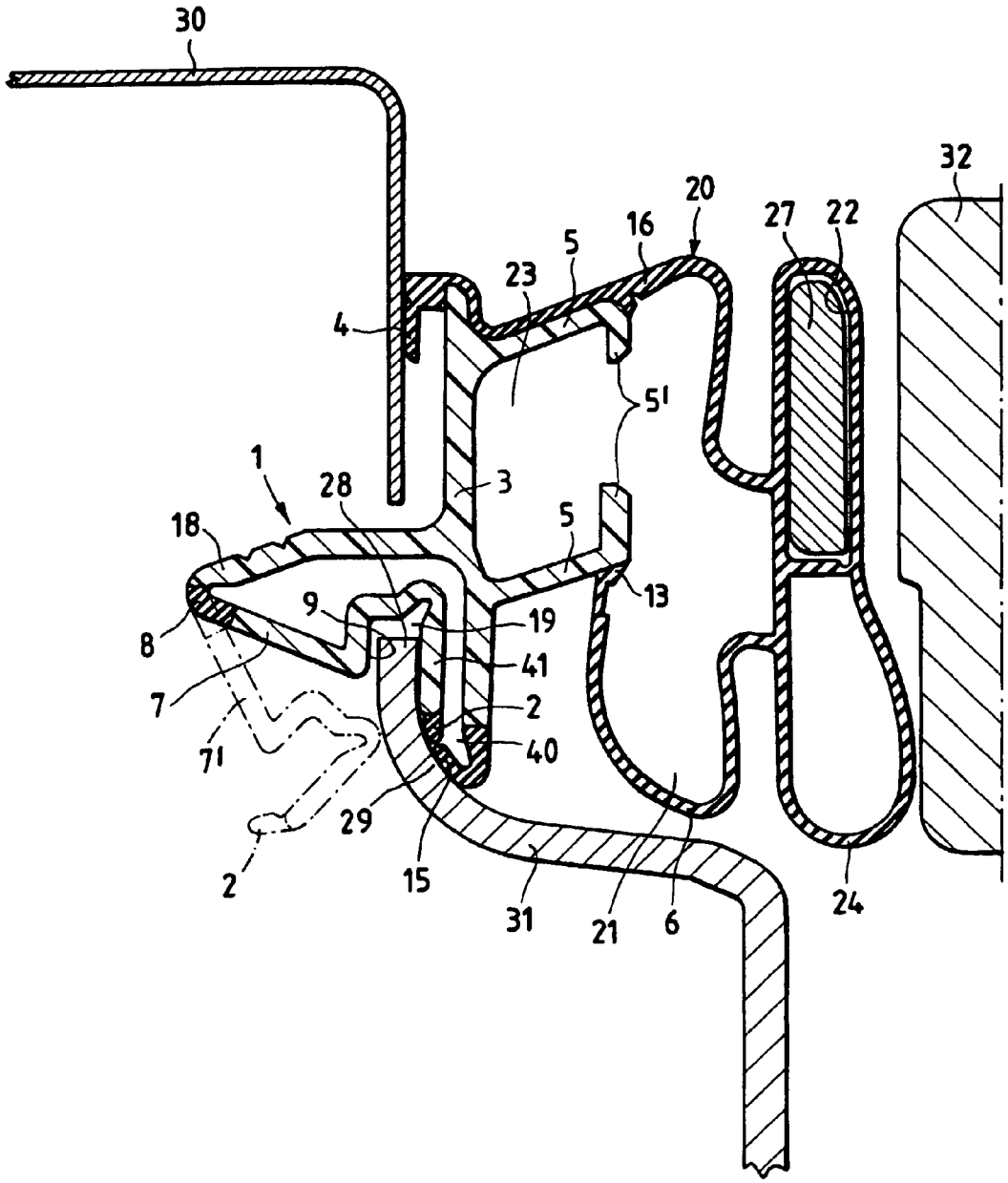
FIG. 2 is a cross-sectional view of the said assembly with the profile in the operative position of assembly on the door and inner door panel, the section being taken along the line II—II of FIG. 1.

In the example of FIG. 2, the aforesaid vertical walls 5 are also slightly inclined in the same direction so as to be oblique and parallel. Alternatively, they could be oblique but divergent, or else not be inclined. In the operative position of coupling as illustrated in FIG. 2, the base 3 of the profile 1 overlaps the door and inner door panel, on which it forms a seal with the above-mentioned sealing strips 4 and 15, respectively.

The profile 1 is made of rigid plastic material, for example PVC, which is extrusion-moulded, cut and welded to the corners in the form of a frame that reproduces the perimeter of the door of the refrigerator cabinet to which it is to be applied.

Moulded together with the profile 1, by co-extrusion, so as to form a single piece, is also a gasket 20, for example made of soft plasticated PVC. The said gasket 20 has a tubular section which identifies an extensible chamber 21 that functions as a bellows, and a top chamber 24 that runs alongside a seat 22 designed to receive a bar of magnetic material, represented schematically and designated by 27. An internal side wall, designated by 6, of the gasket 20 is welded to the corresponding wall 5 of the profile in the point of co-extrusion 13, whilst an external side wall, designated by 16, is welded in an integral way to the corresponding external wall 5 of the profile and along the external side of the base 3.

Figure 6:
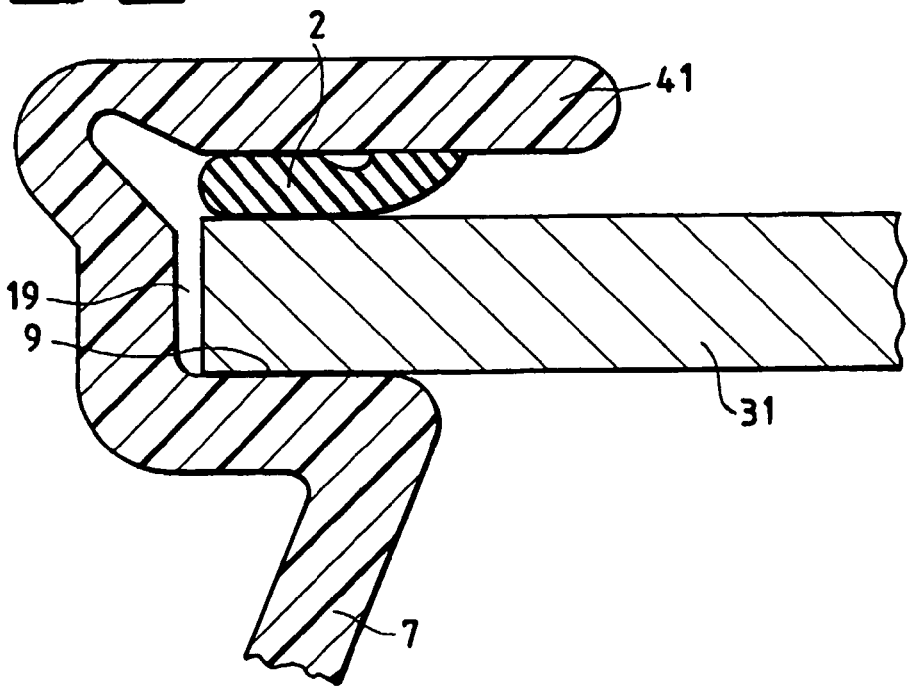
FIG. 6 is a cross-section of the grooved seat of the profile which has a C-shaped cross section as in FIG. 4 but with a different sealing strip.
Figure 7:
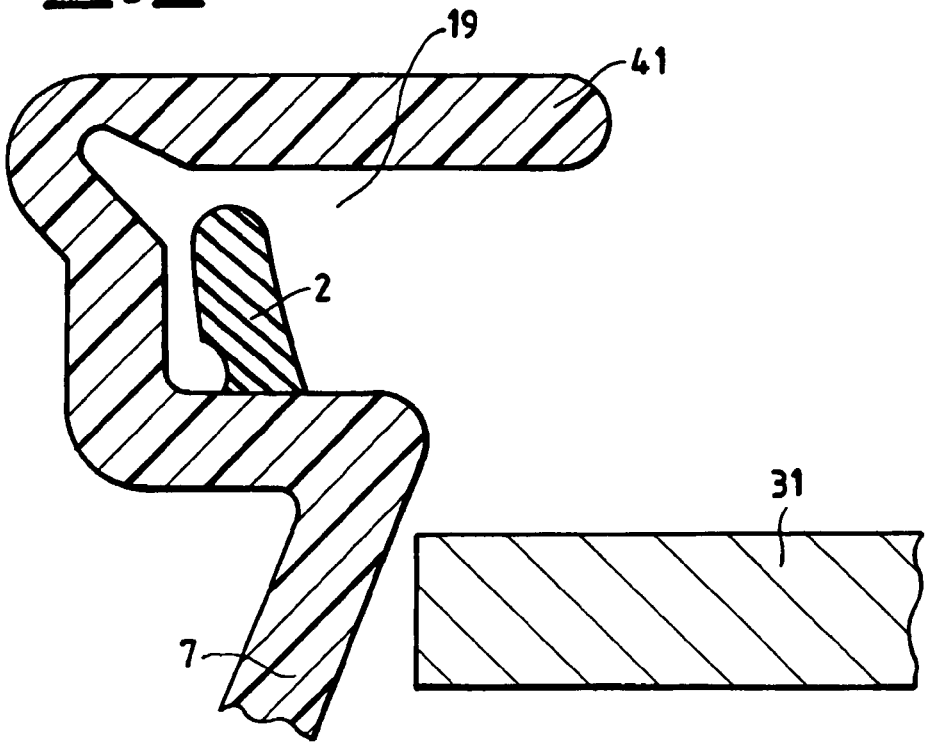
FIG. 7 is a cross-section of the grooved seat of the profile which has a C-shaped cross-section as in FIG. 5 but with a different sealing strip.

As mentioned above, the side branch 7 of the profile operatively facing the inner door panel terminates with a grooved seat 19 having a substantially C-shaped cross-section. As is more clearly highlighted in FIGS. 3 to 8, the said C-shaped section comprises, in addition to the tooth 41 referred to above, also a bottom side 9 designed for resting of the inner door panel in the operative stage, as illustrated in FIG. 4 or FIG. 6.

Figure 3:
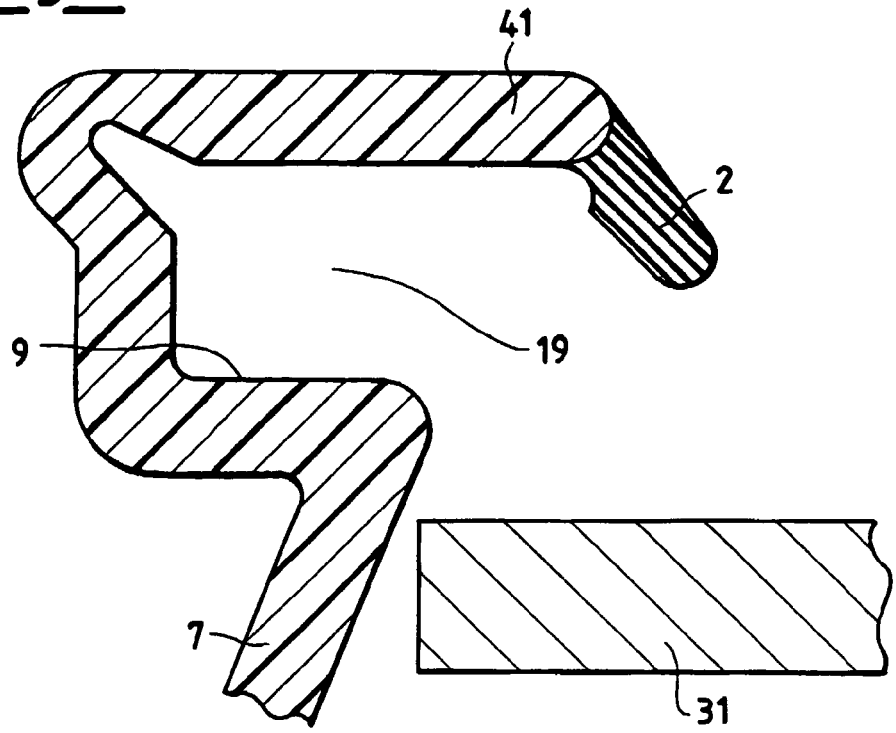
FIG. 3 is a cross-section of the grooved seat of the profile which has a C-shaped cross-section which is shown in the closed position before the sealing strip engages the door edge.
Figure 4:
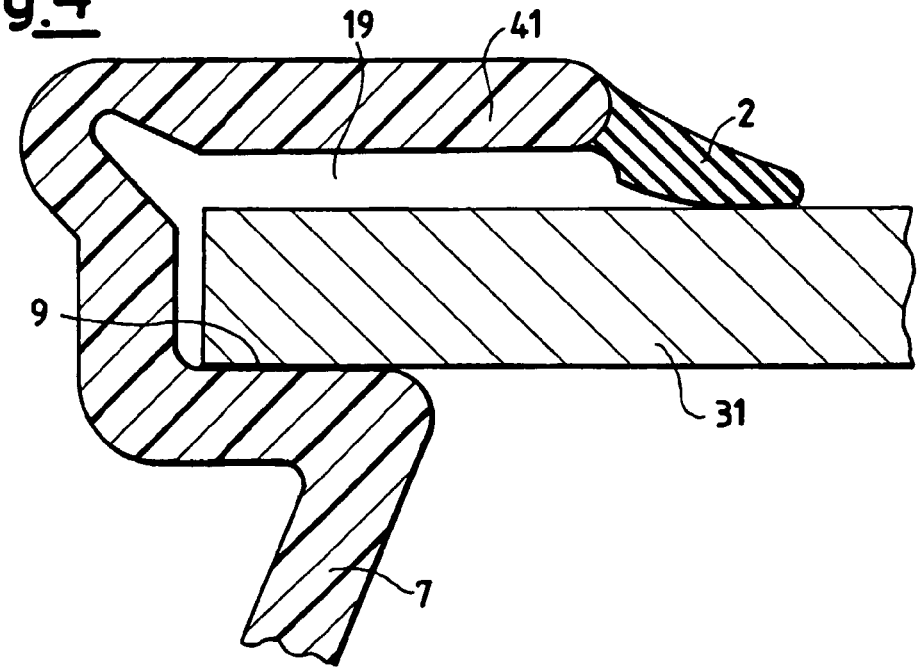
FIG. 4 is a cross-section of the grooved seat of the profile which has a C-shaped cross-section which is shown in the open position where the sealing strip engages the door edge.
Figure 5:
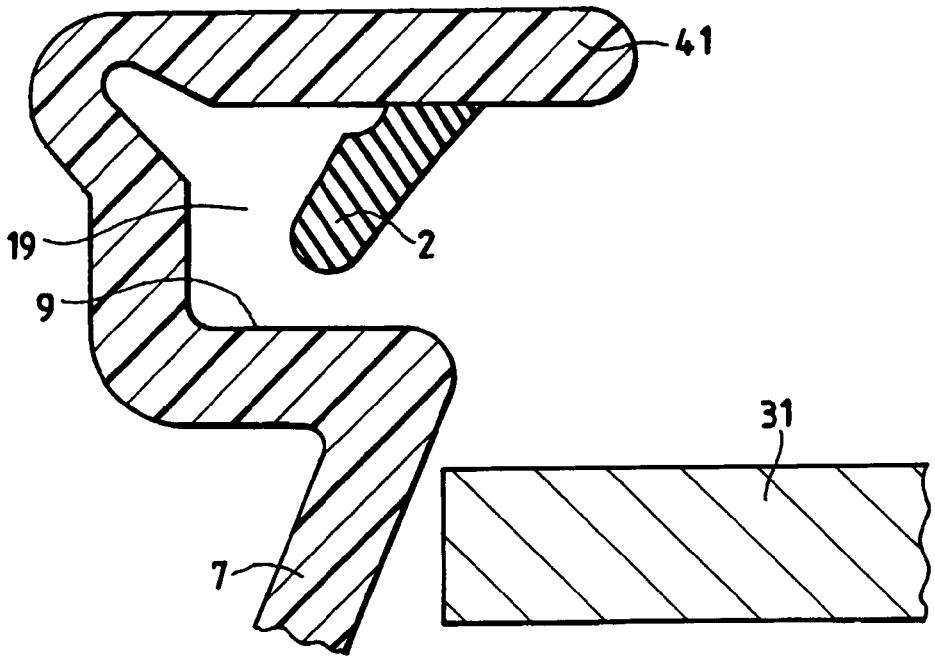
FIG. 5 is a cross-section of the grooved seat of the profile which has a C-shaped cross-section as in FIG. 3 but with a different sealing strip.

In a first embodiment of the profile, illustrated in FIGS. 2, 3 and 4, in the grooved seat 19 having a C-shaped cross-section a sealing strip 2 made of soft co-extruded material is provided along the end of the tooth 41. In the two variants illustrated by the pairs of FIGS. 5–6 and 7–8, the sealing strip 2 is set in different points of the above-mentioned C-shaped cross-section. In particular, in the embodiment of the profile illustrated in FIGS. 5 and 6, the sealing strip 2 is made, at the bottom, in an intermediate point of the tooth 41, whilst in the embodiment of the profile illustrated in FIGS. 7 and 8, it is made on the bottom side 9 of the C-shaped cross-section. In a different embodiment of the profile, in an assembly according to invention not shown in the attached drawings, two or more sealing strips may be provided in different points of the same seat 19 having a C-shaped cross-section.

The sealing strip 15 is made, above all, so as to compensate for the distance between the base 3 of the profile and the inner door panel 31, between which there remains identified a gap 40 for the elastic return of the tooth 41 of the side branch 7, and so as to facilitate the movement of engagement of said side branch 7 on the inner door panel.

The sealing strip 15 has the function of facilitating said movement of the side branch 7 because it maintains the distance between the base of the profile and the inner door panel 31, leaving free play for the tooth 41 in the gap 40. The sealing strip 15 moreover has functions of an aesthetic nature because it covers from sight the underlying rigid profile, which can be made of any shade of colour, without this being detrimental to the appearance of the assembly.

In order to solve the technical problems of leakage of foam, it has moreover been found that an area of bending, designated by 29, of the inner door panel 31, must be at right angles and must have a radius of at least 3 mm up to a maximum of 6 mm. In this way, it is possible to ensure an optimal action of contrast with the sealing strip 15 made at the end of the base 3 of the profile 1. As a result, an effective and secure sealing action against the inner door panel is achieved, preventing any leakage of foam.

Figure 9:
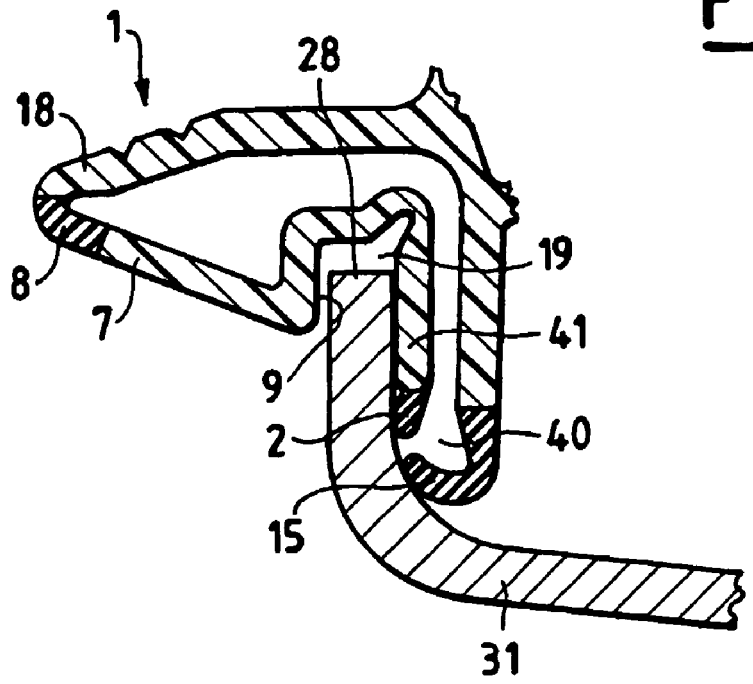
FIG. 9 is a cross-section of the profile as shown in FIG. 2 except the door edge has a different radius of curvature.
Figure 10:
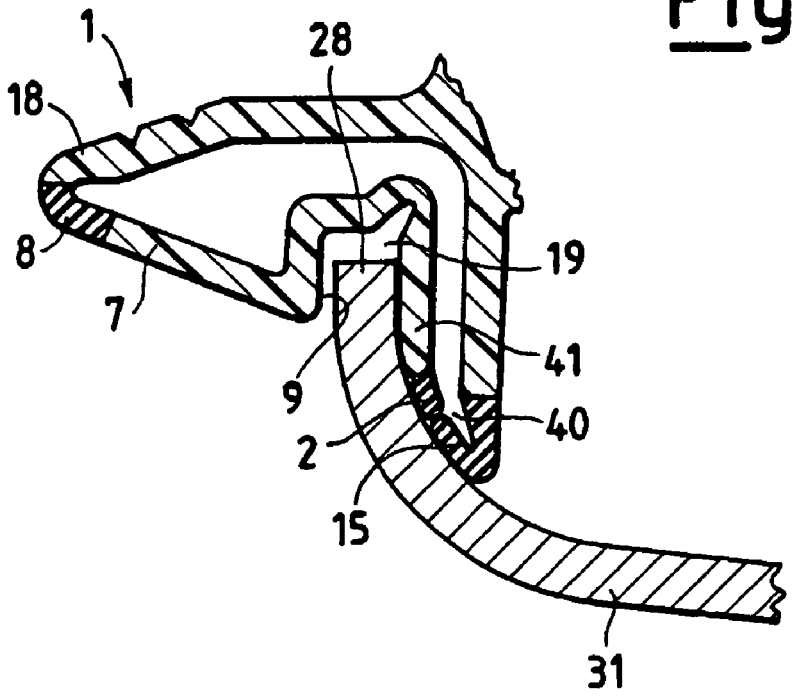
FIG. 10 is a cross-section of the profile as shown in FIG. 2 except the door edge has a different radius of curvature.

FIG. 2 shows how a radius of bending of 5 mm is used, whilst the last two FIGS. 9 and 10 show the action of contrast of the sealing strip 15 with the inner door panel for different radiuses of curvature. It may readily be imagined that with a radius of 3 mm (FIG. 9) the contrast is somewhat deficient, whereas with a radius of 6 mm (FIG. 10) it is, perhaps, excessive. A good action of contrast, and hence a good seal, against leakage of foam is obtained when the radius of bending of the inner door panel is between the aforesaid two limits. It is to be considered that all of the inner door panels currently used have in that point a radius of bending of 1.5 to 2 mm.

The above solution moreover makes it possible to keep the sealing strip 15 of a length such as it does not prevent rotation of the side branch 7 with the grooved seat 19. The radius mentioned above ensures a good action of contrast between the sealing strip 15 and the inner door panel even in sub-optimal conditions of tolerance between the components of the door.

For installation, the profile 1 carrying the co-extruded gasket 20 is conveniently prepared in the form of a frame, and in this form supplied to the manufacturer of the refrigerator, as described in the European patents held by the present applicant already cited above. Coupling of the above frame to the inner door panel may be obtained either manually or using a robotized system. If the operation is carried out manually, it is necessary to push the perimetral edge of the inner door panel against the compliant side branch, first in the corners and then in the perimetral points.

If a robotized system is used, the frame formed with the profile 1 is made to descend, for example by means of an appropriate mechanical arm, towards the inner door panel 31, which is, for instance, suitably positioned on a support that blocks it in place. As soon as the arm of the side branch 7 (in the initial position indicated by the dashed outline 7' in FIG. 2) comes into contact with an end edge 28 of the inner door panel 31, under the thrust of the said edge it yields and starts to bend elastically inwards like a spring about the fulcrum 8, which is in fact flexible. Once the compliant side branch 7 has completed its travel along the edge of the inner door panel 31 and when the said edge has reached the height of the groove 19, the branch 7, as a result of its own elastic return, snaps into position and engages the edge 28 of the inner door panel 31, so blocking the said edge.

In the embodiment of FIGS. 2, 3 and 4, it may therefore be seen how the movement of approach and co-operation between the inner door panel 31 and the side branch 7 leads the sealing strip 2 to assume, in the final operative position, the conformation shown in detail in FIG. 4.

Figure 8:
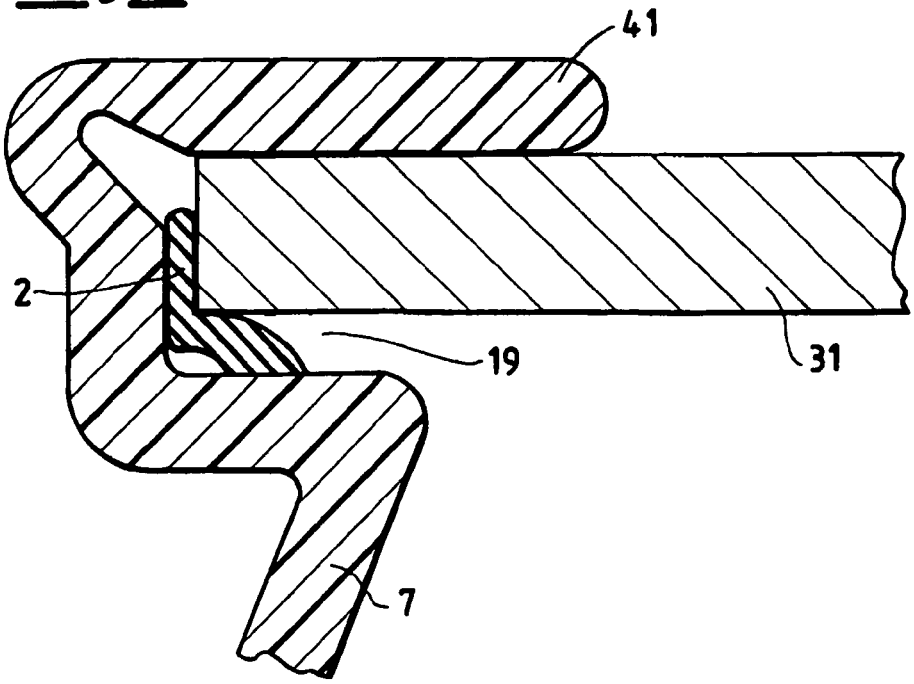
FIG. 8 is a cross-section of the grooved seat of the profile which has a C-shaped cross-section as in FIG. 6 but with a different sealing strip.

FIGS. 6 and 8 illustrate the final operative positions of the sealing strip 2 of the two further embodiments shown in the drawings.

In any case, the aforesaid final operative positions show that, under the action of elastic return of the side branch 7, the sealing strip 2 is always compressed against the edge of the inner door panel 31, so that, in this way, an excellent seal is obtained.

In fact, the profile 1 and the inner door panel 31 thus assembled are then rested on the door 30 (for example, by means of a robotized system), and the entire assembly is blocked by foam-injection into the gap between the door and the inner door panel. Preferably, a counter-mould is positioned on top of the door and inner door panel assembled together with the frame of the profile of the assembly according to the invention in such a way as to exert an adequate counter-thrust against the pressure of the foam material which is injected inside the gap defined between the door and the inner door panel in order to provide thermal insulation.

Prevention of leakage of foam is ensured by the action of contrast between the sealing strip 15, bent to form an L, of the base and the area of bending at right angles 29, of the inner door panel 31, which has a radius of curvature of between 3 and 6 mm.

The sealing strip provided in the grooved seat of the side branch according to the invention is such as to guarantee a sort of seal against a possible leakage of foam between the inner door panel and the profile because the said sealing strip does not merely function as a so-called "static seal", i.e., one obtained by mere resting and contact between the parts in the possible points of leakage of the foam, but operatively works by compressing itself against the edge of the inner door panel, thus deforming its own structure and so providing a seal of considerable and certain effectiveness.

Also the sealing strip 15, in order to create a seal on the inner door panel part with a radius of 3 to 6 mm, is compressed, partially or totally deforming the vertical branch of the L.

It may therefore be seen how the main purpose initially set, namely that of being able to guarantee sealing of the foam in the points of widest dimensional tolerance in the door-inner door panel assembly is effectively achieved by means of the assembly proposed by the present invention.

Optimization of the seal against leakage of foam is obtained essentially thanks to the pressure of the sealing strip 2 made of soft material co-extruded at the end of the tooth 41 of the grooved seat 19 having a C-shaped cross-section, and by the sealing strip 15 having a reversed L shape positioned at the end of the base 3 in the area of bending at right angles 29, of the inner door panel 31, which has a radius of 3 to 6 mm.

The invention claimed is:

1. A sealing assembly in combination with a door (30) for a refrigerator cabinet (32), said door having an inner door panel (31) with a curved surface (29), said sealing assembly having a bellows gasket for sealing between the door and the cabinet (32) and having a profile made of a plastic material, said bellows gasket and said profile being co-extruded together, said profile having a means for receiving a replacement bellows gasket, said profile also having a base and at least one elastically compliant side branch which provides a snap-action connection between the profile and the inner door panel, said side branch terminating with a grooved seat which has a substantially C-shaped cross-section which receives an edge of said inner door panel, wherein said base includes first and second sealing strips, said first and second sealing strips sealing between said door (30) and said base, wherein said grooved seat has a third sealing strip, wherein the elastically compliant side branch causes said third sealing strip to be compressed against the curved surface (29) of the inner door panel (31), and wherein said curved surface of the inner door panel has a radius of curvature of 3 to 6 mm so as to ensure an effective seal with said third sealing strip.

2. The combination according to claim 1, wherein said third sealing strip is co-extruded with said profile.

3. The combination according to claim 1, wherein said third sealing strip is disposed along a distal end portion of said grooved seat.

4. The combination according to claim 1, wherein said second sealing strip is made of a material co-extruded with a material of said base of said profile.

5. The combination according to claim 1 wherein said means for receiving a replacement gasket comprises a pair of walls that extend from said base.

6. The combination according to claim 1, wherein said side branch includes an insert which is made of a material which is more compliant than said plastic material of said profile and enables said side branch to pivot relative to said base.

7. The combination according to claim 1, wherein said bellows gasket overlaps an outer end portion of said profile along the entire length of the profile.

8. The combination according to claim 1, wherein said base is generally contained in a single plane.

9. The combination according to claim 1, wherein said base is contained in generally parallel planes that are slightly staggered with respect to one another.

* * * * *